US005319335A

United States Patent [19]

Huang et al.

[11] Patent Number: 5,319,335

[45] Date of Patent: Jun. 7, 1994

[54] APPARATUS FOR MAGNETIZING A MAGNETIC ROLLER

[75] Inventors: Der-Ray Huang; Wen-Ling Fang, both of Hsinchu, Taiwan

[73] Assignee: Industrial Technology Research Institute, Hsinchu, Taiwan

[21] Appl. No.: 921,568

[22] Filed: Jul. 29, 1992

[51] Int. Cl.[5] ..... H01F 7/20; H01F 13/00

[52] U.S. Cl. ..... 335/284

[58] Field of Search ..... 335/284, 296–298, 335/302–306; 118/657, 658; 355/251, 252, 253; 361/143

[56] References Cited

U.S. PATENT DOCUMENTS 4,166,263 8/1979 Harada et al. ..... 335/284
4,167,718 9/1979 Harada et al. ..... 335/284
4,168,481 9/1979 Harada et al. ..... 335/284
4,169,998 10/1979 Harada et al. ..... 335/284

*Primary Examiner*—Leo P. Picard
*Assistant Examiner*—Raymond Barrera
*Attorney, Agent, or Firm*—Ladas & Parry

[57] ABSTRACT

A magnetizing apparatus capable of magnetizing a magnetic roller having a length up to 30 cm is provided. The magnetizing apparatus is comprised of at least two split members, each of which is provided with magnetic heads employed for applying magnetic fields to a magnetic roller. The end face of each magnetic head is shaped in agreement with the profile of the magnetic roller so that there would be no air gap formed between the magnetic head and the magnetic roller when they come into contact with each other. The split members are separated first and then combined to accommodate the magnetic roller within the magnetizing apparatus. After magnetization, a magnetic force is induced between the magnetic head and the magnetic roller such that an external force stronger than the magnetic force is used to pull the split members apart to fetch out the magnetic roller.

6 Claims, 5 Drawing Sheets

APPARATUS FOR MAGNETIZING A MAGNETIC ROLLER

BACKGROUND OF THE INVENTION

1. Field of the Invention

The present invention relates to an apparatus for producing magnetic rollers (MGR) having multiple magnetic poles.

2. Description of Prior Art

Magnetic rollers are essential elements utilized in electro-photographic systems. A magnetic roller is always formed with multiple magnetic poles, either symmetric or asymmetric.

A conventional technique for producing magnetic rollers is to adhere Sr- or Ba-ferrite strips to a steel bar and subsequently machine the ferrite strips into magnetic rollers. This technique has a drawback that the ferrite strips are often slightly misaligned, resulting in mispositioned magnetic poles. In addition, magnetic fields of the magnetic strips are often degaussed after machining.

In another conventional technique, a method similar to that used in magnetizing magnet rings that are employed in motors is utilized to magnetize a magnetic roller having a length longer than 22 cm. The method of producing magnet rings is adapted to magnetize magnet rings with a length less than 3 cm. Therefore, with such a length longer than 22 cm, it is a drawback of this technique that contacts between magnetic heads and the surface of magnetic roller are often not tight enough to produce magnetic poles having uniformly distributed magnetic fields. In addition to this drawback, the magnetic roller is often difficult to be separated from the magnetic heads due to magnetic forces produced after magnetization.

To solve the problem found in magnetizing a magnetic roller having a substantial length, Kodak company of U.S.A. developed a technique which divides a 30-cm magnetic roller into twelve 2.5-cm magnet rings and then combines each magnetized 2.5-cm magnet ring into a 30-cm MGR. It is a drawback of this technique that magnetic leakage is present at the joint of two 2.5-cm magnetic rings, causing unevenly distributed magnetic fields.

SUMMARY OF THE INVENTION

It is therefore a primary object of the present invention to provide a magnetizing apparatus capable of magnetizing a magnetic roller having a long length.

It is another object of the present invention of the present invention to provide a magnetizing apparatus capable of producing magnetic rollers having uniformly distributed magnetic field.

In accordance with the foregoing objects of the present invention, a magnetizing apparatus comprised of at least two split members is provided. Each of the split members is provided with magnetic heads employed for applying magnetic fields to a magnetic roller. The arrangement of the magnetic heads is determined in accordance with specified magnetic field patterns of the magnetic roller.

Each magnetic head is formed with a concave end face which is in agreement with the profile of the magnetic roller. As a consequence, when the magnetic heads come into contact with the surface of the magnetic roller, there would be no air gap formed therebetween.

When magnetizing a magnetic roller, the split members are separated first and then combined to accommodate the magnetic roller within the magnetizing apparatus. The magnetic heads are then applied with high currents to apply magnetic fields to the magnetic roller. After magnetization, a magnetic force is induced between the magnetic head and the magnetic roller such that an external force stronger than the magnetic force should be used to pull the split members apart to fetch out the magnetic roller.

BRIEF DESCRIPTION OF THE DRAWINGS

The present invention can be more fully understood by reading the subsequent detailed description of the preferred embodiments thereof with references made to the accompanying drawings, wherein:

FIGS. 4A–4B are sectional views of the magnetizing apparatus of FIG. 1 arranged according to a first preferred embodiment, wherein FIG. 4A is shown with the two split members of the magnetizing apparatus separated prior to accommodating a magnetic roller, and FIG. 4B is shown with the two split members combined to magnetize the magnetic roller;

FIGS. 5A–5B are sectional views of the magnetizing apparatus of FIG. 1 arranged according to a second preferred embodiment, wherein FIG. 5A is shown with the two split members of the magnetizing apparatus separated prior to accommodating a magnetic roller, and FIG. 5B is shown with the two split members combined to magnetize the magnetic roller;

DETAILED DESCRIPTION OF THE PREFERRED EMBODIMENTS

Figure 1:
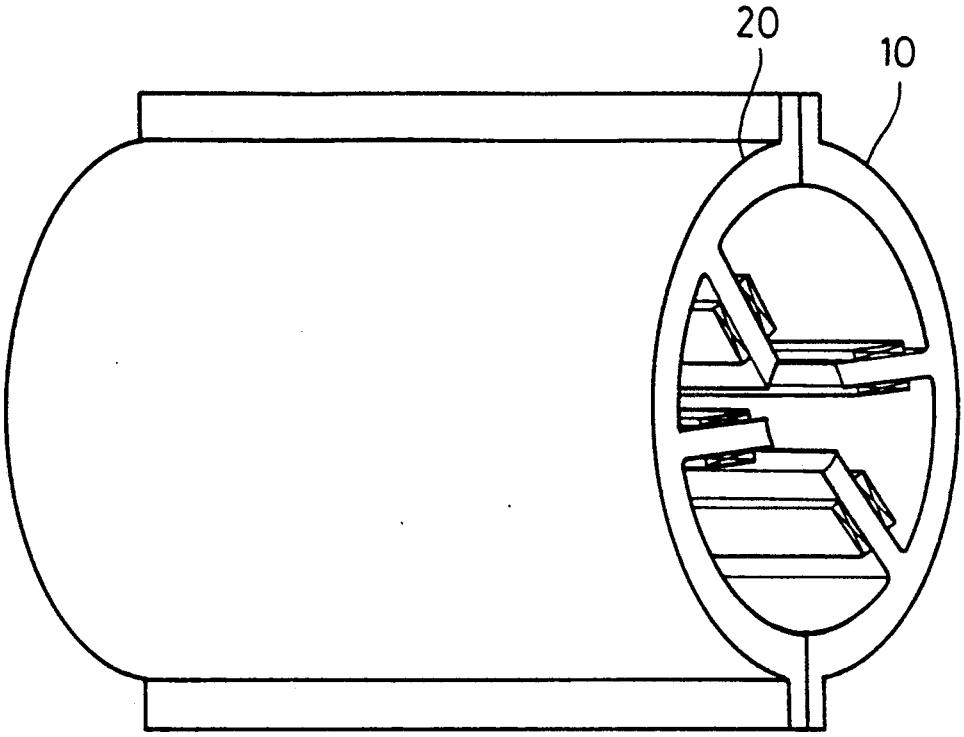
FIG. 1 is a perspective view of a magnetizing apparatus constituted with two split members.
Figure 2:
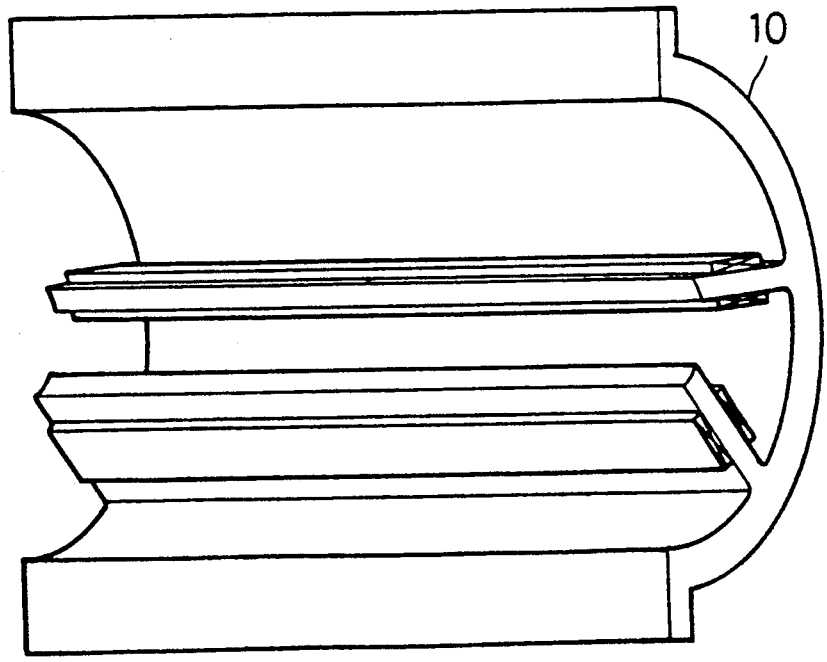
FIG. 2 shows a split member constituting the magnetizing apparatus of FIG. 1.
Figure 3A:
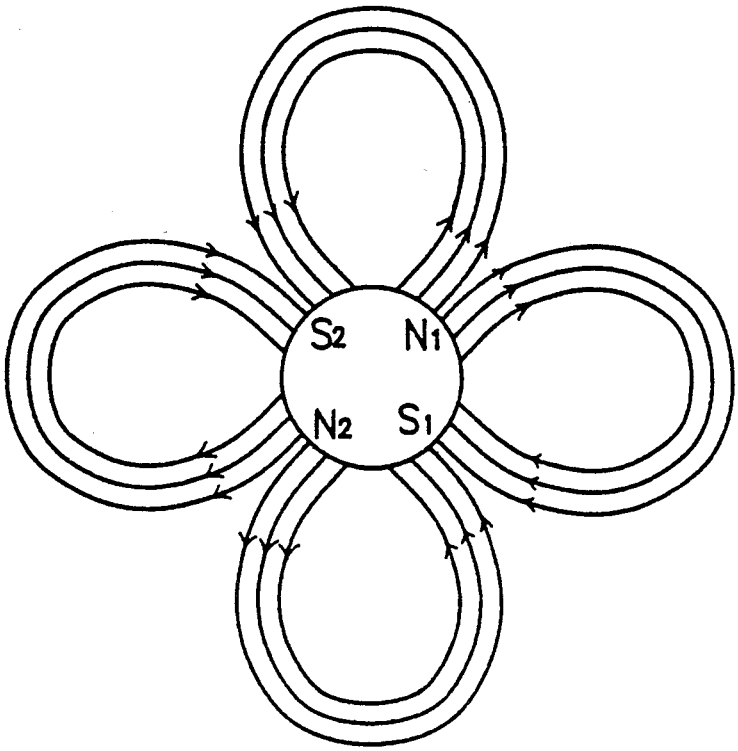
FIGS. 3A–3B are illustrations, depicting particularly the magnetic flux lines of two different magnetic rollers having four symmetric magnetic poles.
Figure 3B:
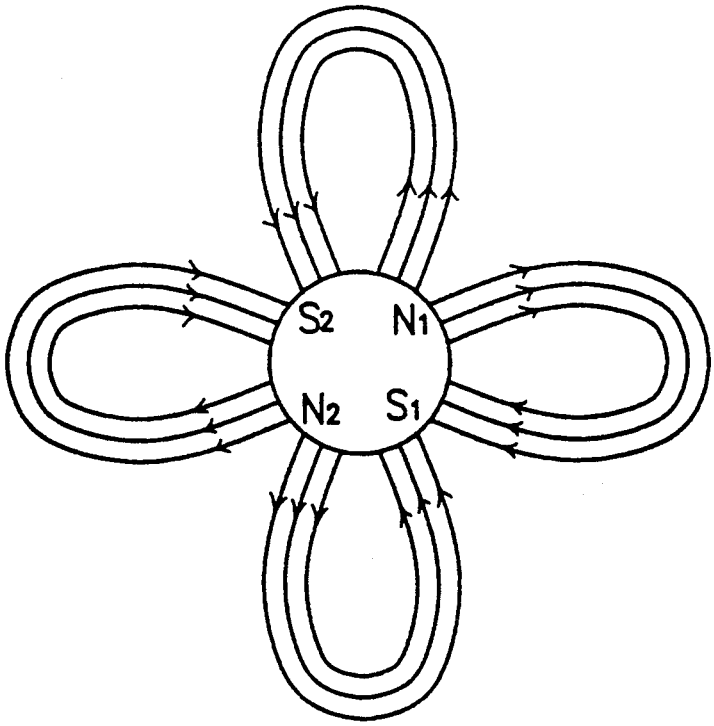

Referring to FIGS. 1–2, a magnetizing apparatus designed in accordance with the present invention is shown. The magnetizing apparatus is cylindrically shaped, comprised of two split members, a first split member 10 and a second split member 20. In this exemplary embodiment of the present invention, the magnetizing apparatus is intended to produce an MGR having four asymmetric magnetic poles as depicted in FIGS. 3A–3B.

Figure 4A:
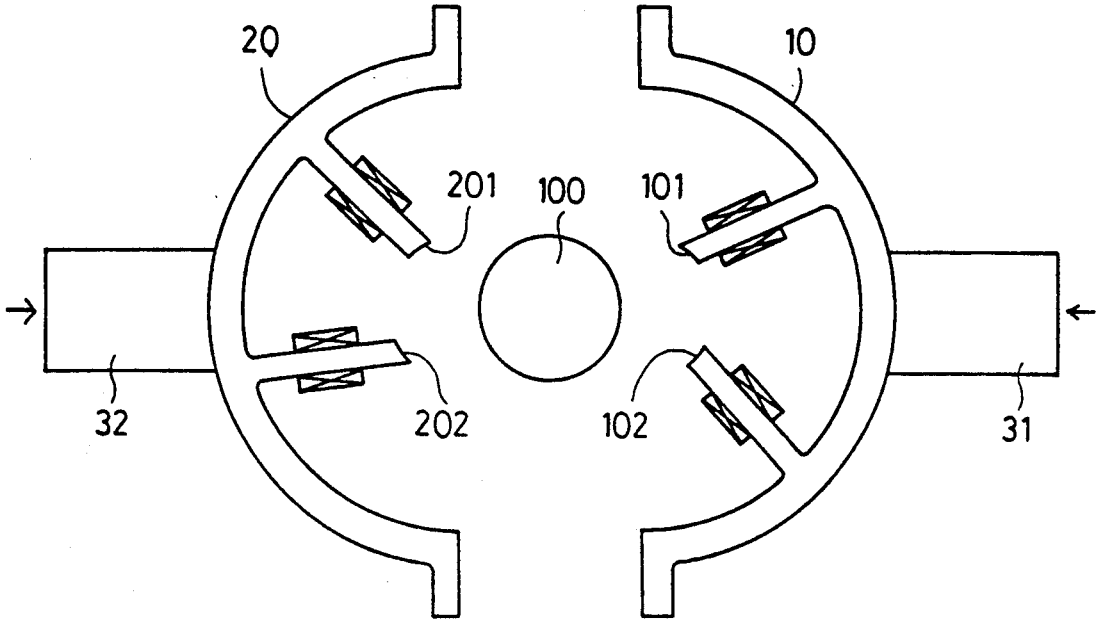
Figure 4B:
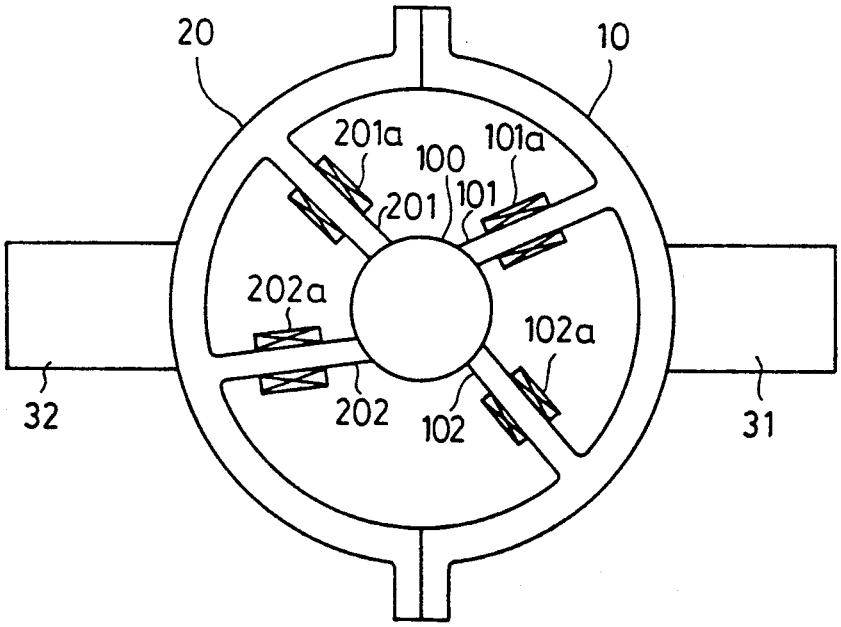

Referring now to FIGS. 4A–4B, the first split member 10 is provided with a pair of magnetic heads, a first N-pole magnetic head 101 and a first S-pole magnetic head 102 on its inner surface; and the second split member 20 is provided with another pair of magnetic heads, a second N-pole magnetic head 201 and a second S-pole magnetic head 202 on its inner surface. The magnetic heads 101, 102, 201, 202 is wound with coils 101*a*, 102*a*, 201*a*, 202*a*.

As a magnetic roller 100, such as an Sr-ferrite magnet, is to be made into an MGR, the two split members 10, 20 are separated as shown in FIG. 4A and then the magnetic roller 100 is mounted onto a stationary portion (not shown). Thereafter, a pair of push-pull bars 31, 32 are used to push the two split members 10, 20 to combine them together and whereby the ends of the magnetic heads 101, 102, 201, 202 come into contact with the surface of the magnetic roller 100.

Since the magnetic roller 100 is provided with a circular cross section, each of the end faces **101*b*, 102*b*, 201*b*, 202*b* of the magnetic heads 101, 102, 201, 202 is shaped in accordance with the profile of the magnetic roller 100 so that the magnetic heads 101, 102, 201, 202 would come in tight contact with the magnetic roller 100** without having air gaps formed therebetween.

Figures 6A, 6B, 7A, 7B, 8A, 8B:
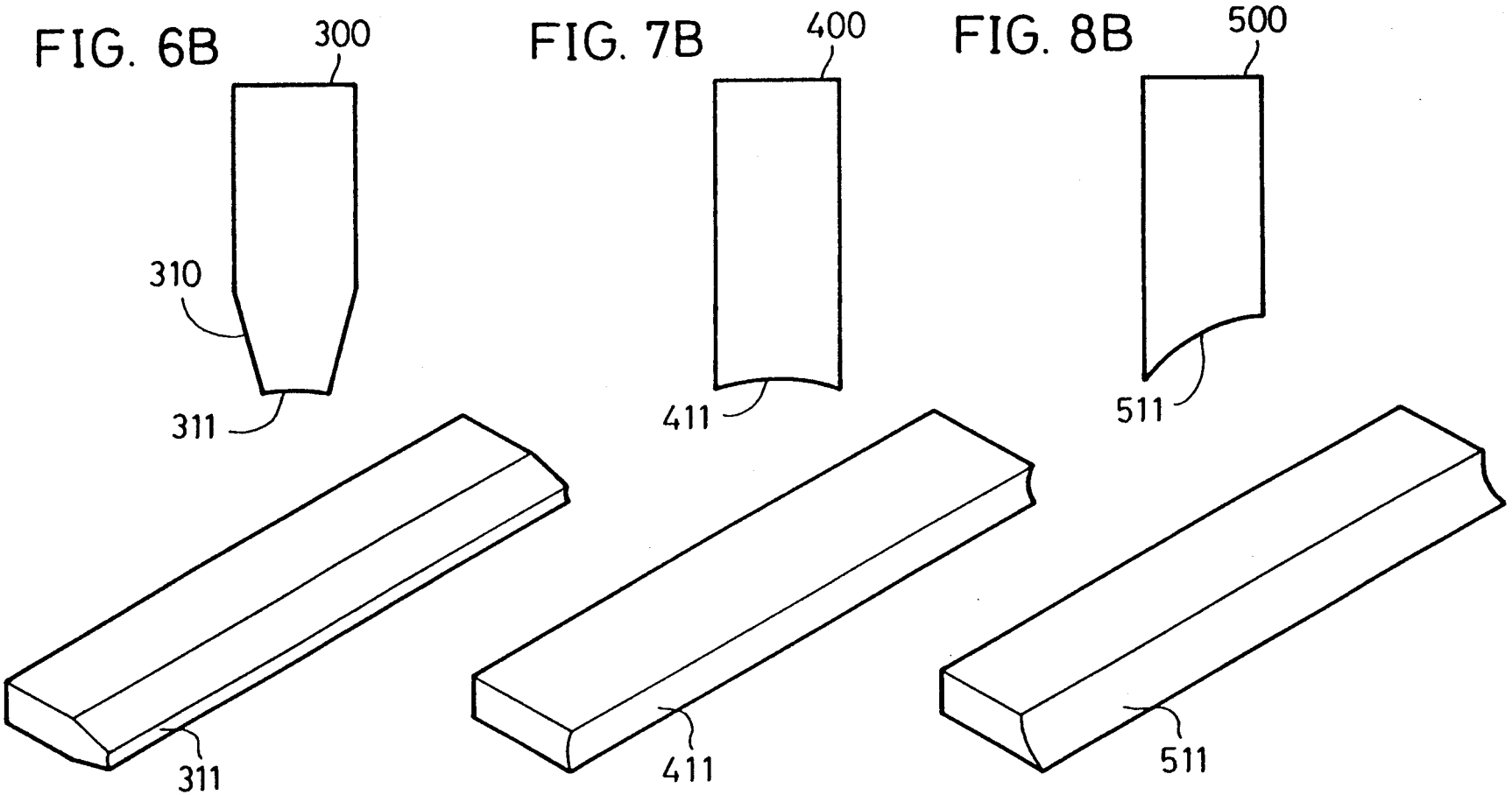
FIGS. 6A–6B show a magnetic head provided with a tapered end.
FIGS. 7A–7B show a magnetic head not provided with a tapered end.
FIGS. 8A–8B show a magnetic head provided with an asymmetric end face.

If it is desired that the magnetic flux emerging from a magnetic pole be more converged to produce a more stronger magnetic field, the magnetic head employed for producing the magnetic pole can be provided with a tapered end, such as a magnetic head 300 shown for example in FIGS. 6A–6B.

If it is desired that the magnetic flux emerging from a magnetic pole be in the radial direction, the magnetic head should be manufactured with a symmetric end face, such as the magnetic head 300 shown in FIGS. 6A–6B or a magnetic head 400 shown in FIGS. 7A–7B. If it is desired that the magnetic flux emerging from a magnetic pole be in a direction having radial and tangential components, the magnetic head should be manufactured with an asymmetric end face, such as a magnetic head 500 shown for example in FIGS. 8A–8B. Magnetic flux emanating from a magnetic pole in a direction having tangential component will form a narrow lobe as that shown in FIG. 3B.

Referring back to FIGS. 4A–4B, once currents are supplied to the coils **101*a*, 102*a*, 201*a*, 202*a* surrounding the magnetic heads 101, 102, 201, 202, the first N-pole magnetic head 101 generates a magnetic field such that the portion where the magnetic roller 100 comes in contact with the first N-pole magnetic head 101 is magnetized into an N-pole, and the first S-pole magnetic head 102 generates a magnetic field such that the portion where the magnetic roller 100 comes in contact with the first S-pole magnetic head 202 is magnetized into an S-pole. The second N-pole magnetic head 201 and the second S-pole magnetic head 202** carry out the same effects.

After the magnetic roller 100 has been magnetized, there are produced magnetic forces attracting the magnetic roller 100 and the magnetic heads 101, 102, 201, 202. The magnetic force is quite strong so that strong pulling forces should be applied to the push-pull bars 31, 32 to separate the two split members 10, 20 from the magnetic roller 100. An MGR is thus produced by fetching the magnetic roller 100 out of the stationary portion (not shown).

Figure 5A:
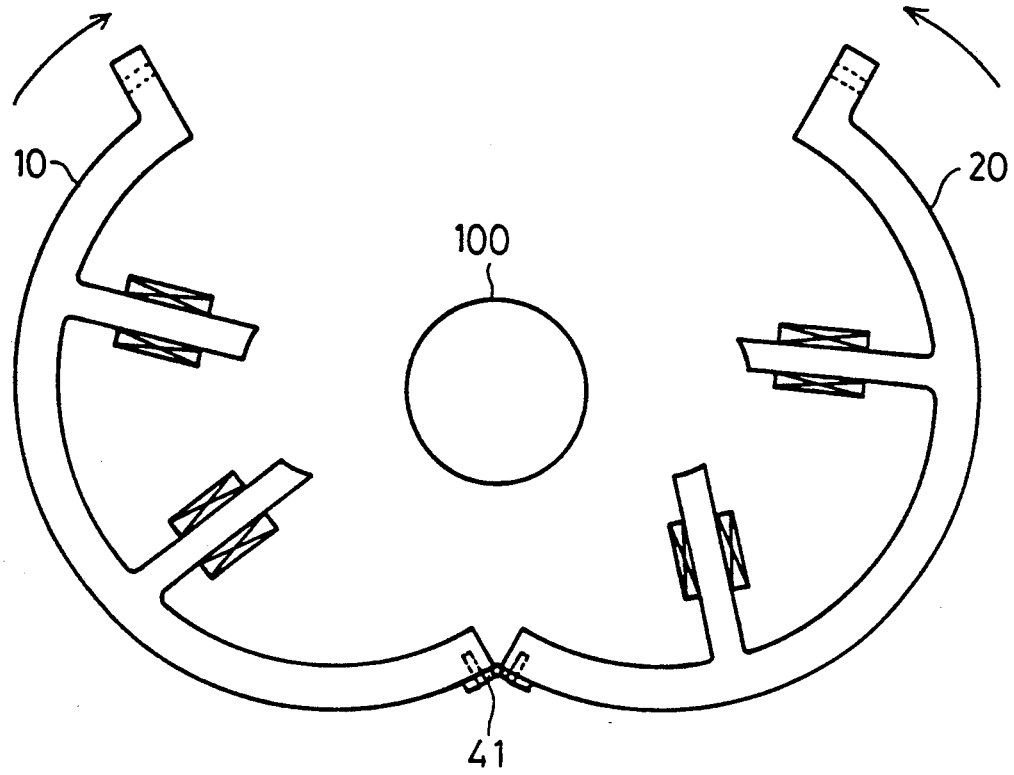
Figure 5B:
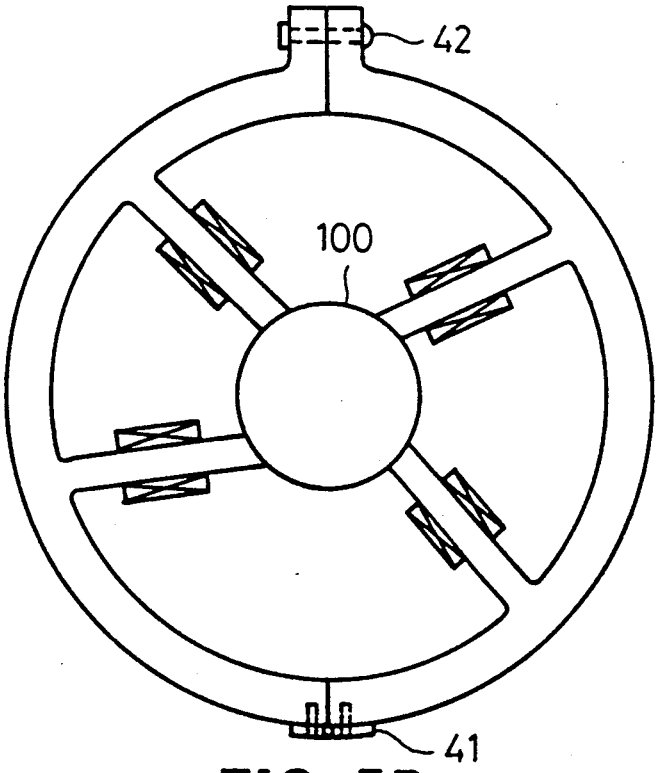

The engaging and disengaging of the two split members 10, 20 can be designed alternatively with another scheme as illustrated in FIGS. 5A–5B. In this embodiment, one end of the first split members 10 and the second split member 20 are engaged with other by a hinge 41; and the other ends of the same are provided with fastening means, such as a series of bolts 42. When a magnetic roller 100 is to be magnetized, the bolts 42 are unfastened to separate the split members 10, 20 as shown in FIG. 4A. The magnetic roller 100 is then mounted to a stationary member (not shown). The split members 10, 20 are thereafter combined so as to encompass the magnetic roller 100 with the magnetic heads 101, 102, 201, 202. The bolts 41 are fastened tight to allow tight contacts between the magnetic roller 100 and the magnetic heads 101, 102, 201, 202.

The magnetizing apparatus as hitherto described can also be used as a demagnetizing apparatus if the coils of the magnetic heads are applied with alternating currents. Besides, though the present invention is described by way of magnetizing apparatuses designed for producing MGRs having four asymmetric magnetic poles, the present invention can be modified for producing MGRs having any number of magnetic poles, not matter symmetric or asymmetric, depending on specified requirements.

Therefore, it is to be understood that the scope of the present invention need not be limited to the disclosed preferred embodiment. On the contrary, it is intended to cover various modifications and similar arrangements within the scope defined in the following appended claims. The scope of the claims should be accorded the broadest interpretation so as to encompass all such modifications and similar arrangements.

What is claimed is:

1. An apparatus for magnetizing a magnetic roller having multiple magnetic poles, said apparatus comprising:

(a) at least two split members;

(b) engaging means capable of combining said split members together;

(c) a predetermined number of magnetic heads arranged with predetermined orientations within said split members for magnetizing the magnetic roller, each of said magnetic heads having an end face shaped in accordance with the profile of the magnetic roller so that each of said magnetic heads comes into tight contact with the magnetic roller when said split members are combined to attach said magnetic heads to the magnetic roller, the magnetic heads being disposed around the magnetic roller at a tilted angle;

wherein as magnetization of the magnetic roller is completed said engaging means is capable of separating said split members from the magnetic roller.

2. An apparatus according to claim 1, wherein any of said magnetic heads are tapered so as to produce a magnetic pole having a converged magnetic flux.

3. An apparatus according to claim 1, wherein said engaging means includes a pair of push-pull bars used to push and pull the split members toward or away from the magnetic roller.

4. An apparatus according to claim 1, wherein said engaging means includes:

at least one hinge provided at one side of each of said two split members, and means, provided at the other side of each of said two split members, for fastening said two split members.

5. An apparatus according to claim 1 wherein the end face of any of said magnetic heads are symmetric.

6. An apparatus according to claim 1 wherein the end face of any of said magnetic heads are asymmetric.

* * * * *